US008398432B1

(12) United States Patent
McClellan et al.

(10) Patent No.: US 8,398,432 B1
(45) Date of Patent: Mar. 19, 2013

(54) GROUNDING STRUCTURES FOR HEADER AND RECEPTACLE ASSEMBLIES

(75) Inventors: Justin Shane McClellan, Camp Hill, PA (US); Jeffrey Byron McClinton, Harrisburg, PA (US); James Lee Fedder, Etters, PA (US); Nathan William Swanger, Mechanicsburg, PA (US); Charles S. Pickles, York, PA (US); Timothy Robert Minnick, Enola, PA (US); Chad W. Morgan, Carneys Point, NJ (US); Dharmendra Saraswat, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/290,499

(22) Filed: Nov. 7, 2011

(51) Int. Cl.
*H01R 13/648* (2006.01)

(52) U.S. Cl. ..... 439/607.07

(58) Field of Classification Search . 439/607.05–607.11
See application file for complete search history.

(56) References Cited

U.S. PATENT DOCUMENTS

| | | | | |
|---|---|---|---|---|
| 7,585,186 | B2 * | 9/2009 | McAlonis et al. | 439/607.05 |
| 7,674,133 | B2 * | 3/2010 | Fogg et al. | 439/607.07 |
| 7,789,676 | B2 * | 9/2010 | Morgan et al. | 439/79 |
| 7,862,376 | B2 * | 1/2011 | Sypolt et al. | 439/607.07 |
| 7,927,143 | B2 * | 4/2011 | Helster et al. | 439/607.05 |
| 7,976,318 | B2 * | 7/2011 | Fedder et al. | 439/79 |
| 7,976,340 | B1 * | 7/2011 | Saraswat et al. | 439/607.07 |
| 7,988,491 | B2 * | 8/2011 | Davis et al. | 439/607.27 |
| 8,157,591 | B2 * | 4/2012 | Fedder et al. | 439/607.07 |
| 8,157,595 | B2 * | 4/2012 | Saraswat et al. | 439/620.09 |
| 8,167,651 | B2 * | 5/2012 | Glover et al. | 439/607.08 |
| 8,187,034 | B2 * | 5/2012 | Fedder et al. | 439/607.01 |
| 8,262,412 | B1 * | 9/2012 | Minnick et al. | 439/607.01 |
| 2008/0194146 | A1 * | 8/2008 | Gailus | 439/608 |
| 2009/0093158 | A1 * | 4/2009 | McAlonis et al. | 439/610 |
| 2009/0239395 | A1 * | 9/2009 | Cohen et al. | 439/65 |
| 2009/0246980 | A1 * | 10/2009 | Knaub et al. | 439/65 |
| 2009/0311908 | A1 * | 12/2009 | Fogg et al. | 439/607.05 |
| 2010/0015822 | A1 * | 1/2010 | Morgan et al. | 439/83 |
| 2010/0022129 | A1 * | 1/2010 | Morgan | 439/607.05 |
| 2010/0029105 | A1 * | 2/2010 | Knaub et al. | 439/78 |
| 2010/0048058 | A1 * | 2/2010 | Morgan et al. | 439/607.05 |
| 2010/0144167 | A1 * | 6/2010 | Fedder et al. | 439/68 |
| 2010/0144168 | A1 * | 6/2010 | Glover et al. | 439/68 |
| 2010/0144169 | A1 * | 6/2010 | Glover et al. | 439/68 |
| 2010/0144174 | A1 * | 6/2010 | Glover et al. | 439/108 |
| 2010/0144175 | A1 * | 6/2010 | Helster et al. | 439/108 |
| 2010/0144201 | A1 * | 6/2010 | Defibaugh et al. | 439/607.05 |
| 2010/0144204 | A1 * | 6/2010 | Knaub et al. | 439/607.07 |
| 2010/0151726 | A1 * | 6/2010 | Fedder et al. | 439/540.1 |
| 2010/0151741 | A1 * | 6/2010 | Fedder et al. | 439/638 |
| 2010/0297880 | A1 * | 11/2010 | Mizukami | 439/607.11 |
| 2011/0003509 | A1 * | 1/2011 | Gailus | 439/607.08 |
| 2011/0143591 | A1 * | 6/2011 | Davis et al. | 439/607.27 |
| 2011/0230096 | A1 * | 9/2011 | Atkinson et al. | 439/607.08 |
| 2012/0015556 | A1 * | 1/2012 | Saraswat et al. | 439/620.09 |
| 2012/0184138 | A1 * | 7/2012 | Davis et al. | 439/607.3 |
| 2012/0184140 | A1 * | 7/2012 | Davis et al. | 439/607.34 |
| 2012/0202380 | A1 * | 8/2012 | Lappoehn | 439/607.09 |

* cited by examiner

*Primary Examiner* — Ross Gushi

(57) ABSTRACT

A receptacle assembly includes a contact module having a conductive holder has a first side and an opposite second side. The conductive holder has a chamber between the first and second sides. A frame assembly is received in the chamber of the conductive holder. The frame assembly includes a plurality of contacts and a dielectric frame supporting the contacts. The contacts extend from the conductive holder for electrical termination. A ground lead frame is received in the chamber between the frame assembly and the conductive holder. The ground leadframe has grounding members that extend from the conductive holder for electrical termination to header shields of the header assembly.

20 Claims, 4 Drawing Sheets

GROUNDING STRUCTURES FOR HEADER AND RECEPTACLE ASSEMBLIES

BACKGROUND OF THE INVENTION

The subject matter herein relates generally to grounding structures in connector assemblies.

Electrical systems, such as those used in networking and telecommunication systems; utilize receptacle and header connectors to interconnect components of the system, such as a motherboard and daughtercard. However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact, such as at a point above a differential pair of signal contacts. Some known connectors provide side shielding along the sides of the differential pairs in the form of a folded-over ground tab on each side of the differential pair, which is implemented on the header connector as part of the ground contact of the header connector. However, known connector systems do not include a direct connection of the folded-over ground tabs to a side shield of the receptacle connector, which causes the folded-over ground tabs to act as resonating structures that cause crosstalk at higher frequency applications.

A need remains for an electrical system having improved shielding to meet particular performance demands.

BRIEF DESCRIPTION OF THE INVENTION

In one embodiment, a receptacle assembly is provided having a contact module that includes a conductive holder having a first side and an opposite second side. The conductive holder has a chamber between the first and second sides. A frame assembly is received in the chamber of the conductive holder. The frame assembly includes a plurality of contacts and a dielectric frame that supports the contacts. The contacts extend from the conductive holder for electrical termination. A ground leadframe is received in the chamber between the frame assembly and the conductive holder. The ground leadframe has grounding members that extend from the conductive holder for electrical termination to header shields of the header assembly.

In another embodiment, a receptacle assembly is provided having a front housing configured for mating with a header assembly. A contact module is coupled to the front housing. The contact module includes a conductive holder that has a first holder member and second holder member coupled to the first holder member. The conductive holder has a front coupled to the front housing and a bottom that is configured to be mounted to a circuit board. The conductive holder has a chamber between the first and second holder members. The chamber includes a plurality of channels extending between the front and the bottom. A frame assembly is received in the chamber. The frame assembly includes a first frame member that is received in the first holder member and a second frame member received in the second holder member. Each frame member includes a plurality of contacts and a dielectric frame that support the contacts. The contacts are routed through corresponding channels. The contacts extend from the front and the bottom for electrical termination. A first ground leadframe is received in the chamber in the first holder member between the first frame member and the first holder member. The first ground leadframe has traces that are routed through corresponding channels. The first ground leadframe has grounding members that extend from the conductive holder for electrical termination to header shields of the header assembly. A second ground leadframe is received in the chamber in the second holder member between the second frame member and the second holder member. The second ground leadframe has traces that are routed through corresponding channels. The second ground leadframe has grounding members that extend from the conductive holder for electrical termination to header shields of the header assembly.

In a further embodiment, an electrical connector assembly is provided having a header assembly that includes a header housing. A plurality of header contacts held by the header housing, and a plurality of C-shaped header shields surrounding corresponding header contacts. The header shields have walls that define the C-shaped header shields. A receptacle assembly is matable to the header assembly. The receptacle assembly includes a front housing that is matable to the header housing. A contact module coupled to the front housing. The contact module includes a conductive holder that has a first holder member and second holder member coupled to the first holder member. The conductive holder has a front coupled to the front housing and a bottom configured to be mounted to a circuit board. The conductive holder has a chamber between the first and second holder members. The chamber includes a plurality of channels that extend between the front and the bottom. A frame assembly is received in the chamber. The frame assembly includes a first frame member that is received in the first holder member and a second frame member received in the second holder member. Each frame member includes a plurality of contacts and a dielectric frame that support the contacts. The contacts are routed through corresponding channels. The contacts extend from the front of the conductive holder for electrical termination to corresponding header contacts. A first ground lead frame is received in the chamber in the first holder member between the first frame member and the first holder member. The first ground leadframe has traces that are routed through corresponding channels. The first ground leadframe has grounding members that extend from the conductive holder for electrical termination to header shields of the header assembly. A second ground leadframe is received in the chamber in the second holder member between the second frame member and the second holder member. The second ground leadframe has traces that are routed through corresponding channels. The second ground leadframe has grounding members that extend from the conductive holder for electrical termination to header shields of the header assembly.

DETAILED DESCRIPTION OF THE INVENTION

Figure 1:
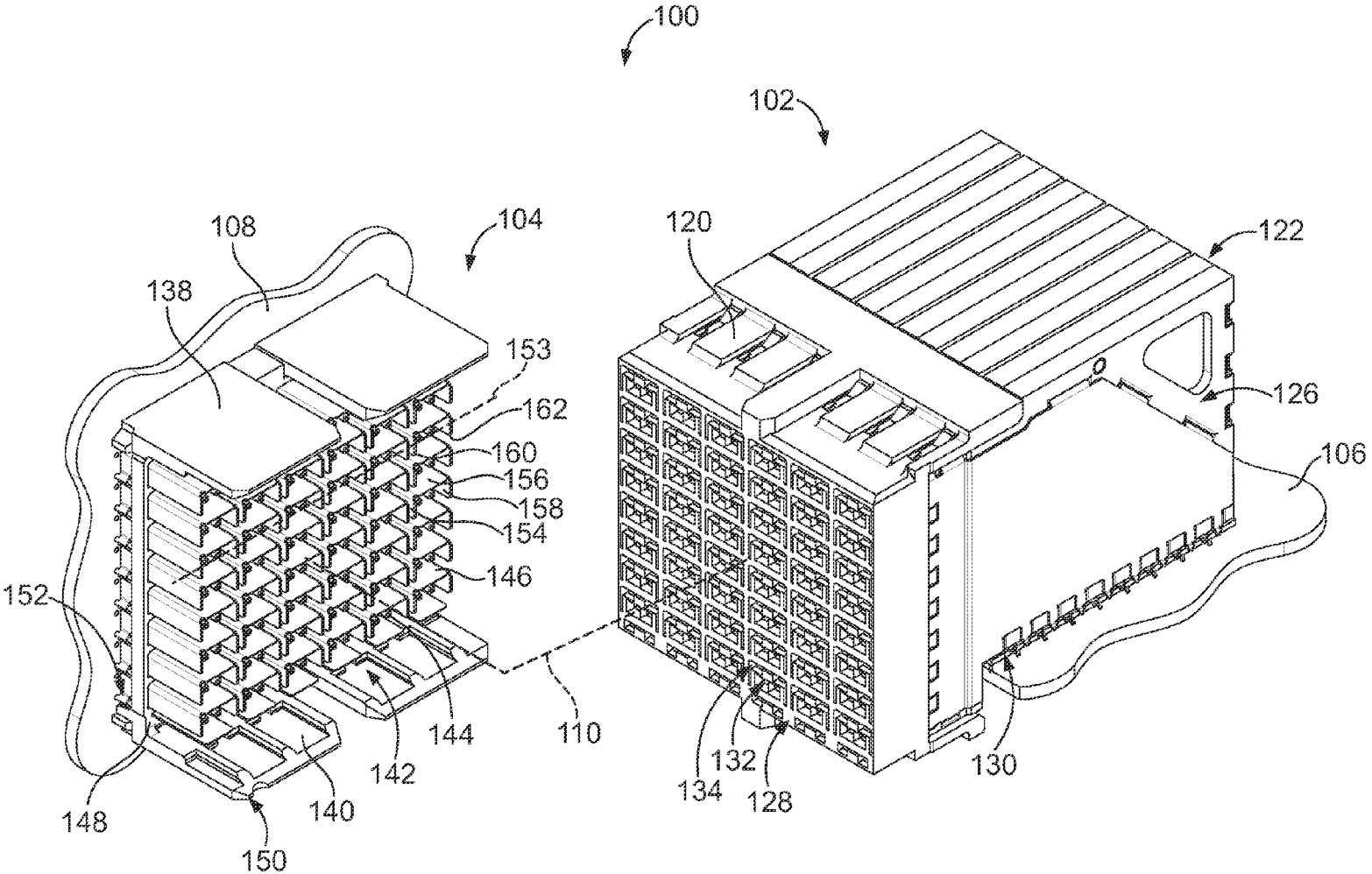
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. The shield structure 126 includes multiple components, electrically interconnected, which provide the electrical shielding. Optionally, the shield structure 126 may provide electrical shielding for differential pairs of the receptacle signal contacts 124 to shield the differential pairs from one another. In an exemplary embodiment, the shield structure 126 is electrically connected to the header assembly 104 and/or the circuit board 106. For example, the shield structure 126 may be electrically connected to the header assembly 104 by extensions (e.g. beams, clips or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The columns of receptacle signal contacts 124 are all held in a common contact module 122. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding members 302 (shown in FIG. 2) and grounding members 332 (shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108. In an alternative embodiment, the header assembly may be a cable mounted header assembly with individual cable mounted header connectors (e.g. signal contacts and header shields), which are held in a common header housing.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
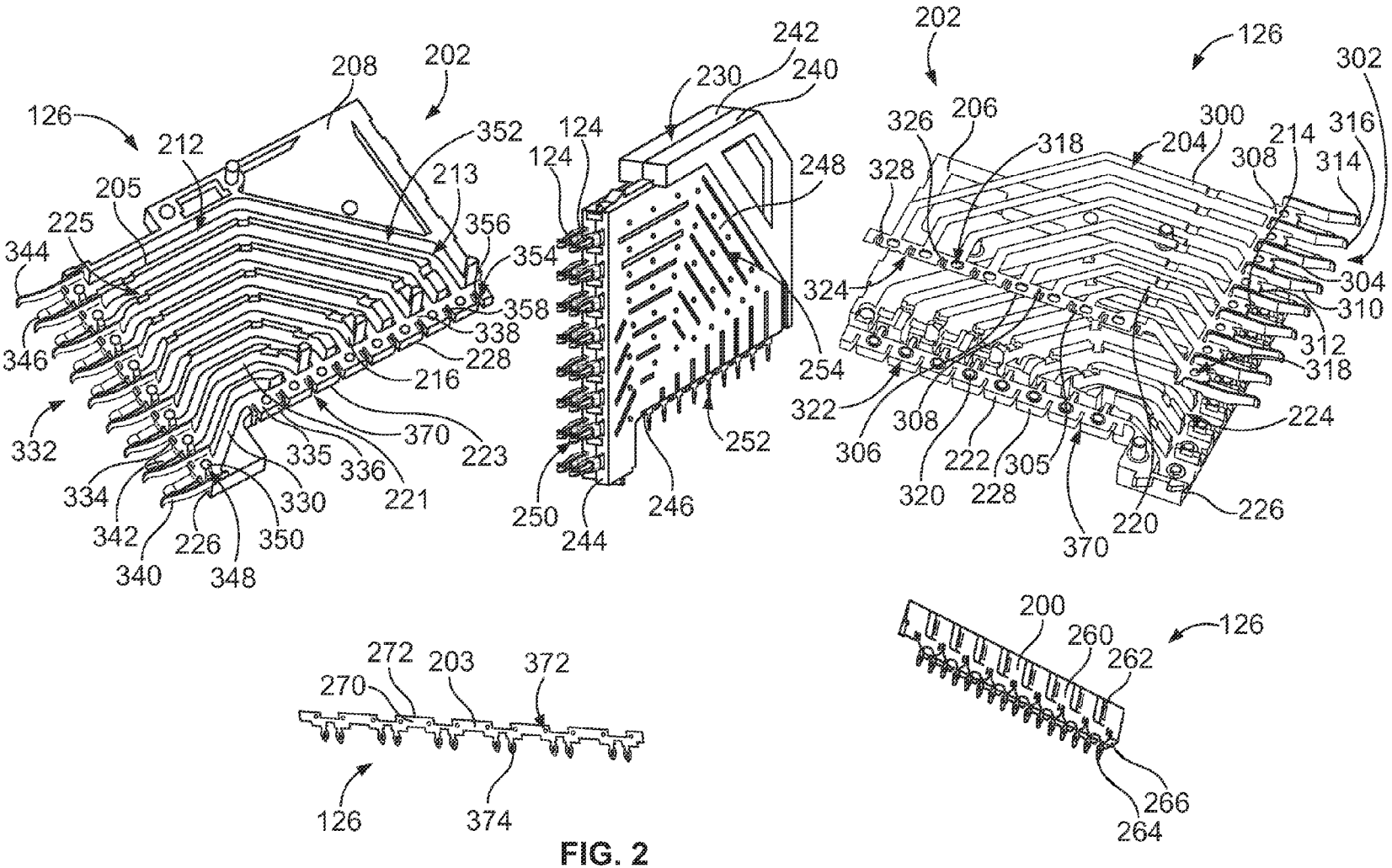
FIG. 2 is an exploded view of a contact module for the receptacle assembly shown in FIG. 1.

FIG. 2 is an exploded view of one of the contact modules 122 and part of the shield structure 126. The shield structure 126 includes a side shield 200, a conductive holder 202, a plurality of busbars 203 (only one is shown) and ground leadframes 204, 205 that are configured to be coupled to the conductive holder 202. FIG. 2 illustrates the ground leadframe 205 coupled to the conductive holder 202, but illustrates the ground leadframe 204 exploded from the conductive holder 202. The ground leadframes 204, 205 electrically connect the contact module 122 to the header shields 146 (shown in FIG. 1). The ground leadframes 204, 205 provide multiple, redundant points of contact to the header shield 146. The ground leadframes 204, 205 provide shielding on all sides of the receptacle signal contacts 124. The buss bars 203 and side shield 200 electrically connect the contact module 122 to the circuit board 106 (shown in FIG. 1).

The contact module 122 includes the conductive holder 202, which in the illustrated embodiment includes a first holder member 206 and a second holder member 208 that are coupled together to form the holder 202. The holder members 206, 208 are fabricated from a conductive material. For example, the holder members 206, 208 may be die-cast from a metal material. Alternatively, the holder members 206, 208 may be stamped and formed or may be fabricated from a plastic material that has been metalized or coated with a metallic layer. By having the holder members 206, 208 fabricated from a conductive material, the holder members 206, 208 may provide electrical shielding for the receptacle assembly 102. When the holder members 206, 208 are coupled together, the holder members 206, 208 define at least a portion of the shield structure 126 of the receptacle assembly 102.

The holder members 206, 208 include chambers 210, 212 that together define a common chamber 213 of the conductive holder 202. The chamber 213 of the conductive holder 202 receives a frame assembly 230, which includes the receptacle signal contacts 124, therein. The holder members 206, 208 provide shielding around the frame assembly 230 and receptacle signal contacts 124. The chambers 210, 212 are defined by internal surfaces 214, 216 of side walls 222, 223, respectively, of the holder members 206, 208. In an exemplary embodiment, the ground leadframes 204, 205 are received in the chambers 210, 212, respectively. The ground leadframes 204, 205 are coupled to the internal surfaces 214, 216, respectively.

The holder members 206, 208 include tabs 220, 221 extending inward from side walls 222, 223 thereof. The tabs 220 extend into the chamber 210 and divide the chamber 210 into discrete channels 224. The channels 224 are bounded by the tabs 220 and the internal surface 214 extending between the tabs 220. The tabs 221 extend into the chamber 212 and divide the chamber 212 into discrete channels 225. The channels 225 are bounded by the tabs 221 and the internal surface 216 extending between the tabs 221. The tabs 220, 221 define at least a portion of the shield structure 126 of the receptacle assembly 102. The tabs 220, 221 provide shielding between the channels 224 and the channels 225, respectively. When assembled, the holder members 206, 208 are coupled together and the channels 224, 225 are aligned to form common channels that are completely surrounded by the conductive material of the holder members 206, 208 (e.g. the side walls 222, 223 and tabs 220, 221), thus providing 360° shielding for the receptacle signal contacts 124 received therein. When assembled, the holder members 206, 208 define a front 226 and a bottom 228 of the conductive holder 202.

The contact module 122 includes the frame assembly 230, which is held by the conductive holder 202. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the dielectric frames 240, 242 other than overmolding a lead frame, such as loading receptacle signal contacts 124 into a formed dielectric body.

The dielectric frames 240, 242 are substantially similar and only the dielectric frame 240 will be described in detail. The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 202 and the contact tails 252 extend downward from the bottom 228 of the holder 202.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the dielectric frame 240 and corresponding receptacle signal contacts 124 are loaded into the chamber 210 and are coupled to the holder member 206. The frame members 248 are received in corresponding channels 224. The tabs 220 are received in corresponding windows 254 such that the tabs 220 are positioned between adjacent receptacle signal contacts 124. The dielectric frame 242 and corresponding receptacle signal contacts 124 are loaded into the chamber 212 and are coupled to the holder member 208 in a similar manner, with the tabs 221 extending through the dielectric frame 242.

The holder members 206, 208, which are part of the shield structure 126, provide electrical shielding between and around respective receptacle signal contacts 124. The holder members 206, 208 provide shielding from electromagnetic interference (EMI) and/or radio frequency interference (RFI). The holder members 206, 208 may provide shielding from other types of interference as well. The holder members 206, 208 provide electrical shielding around the outside of the frames 240, 242, and thus around the outside of all of the receptacle signal contacts 124, as well as between the receptacle signal contacts 124, such as between pairs of receptacle signal contacts 124, using the tabs 220, 221. The holder members 206, 208 control electrical characteristics, such as impedance control, cross-talk control, and the like, of the receptacle signal contacts 124.

The side shield 200 includes a main body 260. In the illustrated embodiment, the main body 260 is generally planar. The main body 260 is configured to be electrically and mechanically coupled to an exterior of the conductive holder 202 at the first side wall 222. The main body 260 is substantially smaller than the first side wall 222, for example, covers less than half of the first side wall 222. The side shield 200 includes a plurality of mounting tabs 262 extending inward from the main body 260. The mounting tabs 262 are configured to be coupled to the holder member 206. The mounting tabs 262 secure the side shield 200 to the first side wall 222. The mounting tabs 262 engage the holder member 206 to electrically connect the side shield 200 to the holder member 206. Any number of mounting tabs 262 may be provided. The location of the mounting tabs 262 may be selected to secure various portions of the side shield 200, such as the top, the back, the front, the bottom, and the like of the side shield 200 to the holder member 206.

The side shield 200 includes ground pins 264 extending from a bottom 266 of the side shield 200. The ground pins 264 are configured to be terminated to the circuit board 106 to electrically connect the conductive holder 202 to the circuit board 106. The ground pins 264 may be compliant pins, such as eye-of-the-needle pins, that are through-hole mounted to plated vias in the circuit board 106. Other types of termination means or features may be provided in alternative embodiments to couple the side shield 200 to the circuit board 106.

The ground leadframe 204 is separate and distinct from the conductive holder 202, the ground leadframe 205, the side shield 200 and the frame assembly 230. The ground leadframe 204 is manufactured from a metal material. In an exemplary embodiment, the ground leadframe 204 is stamped and formed. The ground leadframe 204 includes a plurality of traces 300 that form a leadframe extending between grounding members 302 that extend forward from a front 304 of the ground leadframe 204 and ground pads 305 at a bottom 306 of the ground leadframe 204.

The traces 300 are received in corresponding channels 224. The traces 300 mirror the paths of the receptacle signal contacts 124 through the dielectric frames 240. The traces 300 are connected by bussing portions 308 that electrically interconnect each of the traces 300. In the illustrated embodiment, the bussing portions 308 are provided proximate to the front 304 of the ground leadframe 204 and proximate to a bottom 306 of the ground leadframe 204. The bussing portions 308 may be provided at other locations in alternative embodiments. The grounding members 302 are configured to engage corresponding header shields 146. The grounding pads 305 are configured to engage corresponding busbars 203.

In the illustrated embodiment, the ground leadframe 204 includes two types of grounding members 302, namely grounding beams 310 and grounding fingers 312. The grounding beams 310 are configured to be positioned between receptacle signal contacts 124 (e.g. in column with the receptacle signal contacts 124), while the grounding fingers 312 are configured to extend along the receptacle signal contacts 124 (e.g. aligned in row with the receptacle signal contacts 124, but out of column). The grounding beams 310 are configured to directly engage the center walls 156 (shown in FIG. 1) of the header shields 146, while the grounding fingers 312 are configured to directly engage the side walls 154 (shown in FIG. 1) of the header shields 146. The grounding fingers 312 are shorter than the grounding beams 310 such that the grounding fingers 312 engage the header shields 146 closer to the front 226 of the conductive holder 202 than the grounding beams 310. Other types of grounding members 302 may be used in alternative embodiments, such as grounding members that engage edges of the header shields 146 or other parts of the header shields 146.

In an exemplary embodiment, the grounding beams 310 are bent out of plane with respect to a plane defined by the traces 300 such that the grounding beams 310 are oriented perpendicular with respect to the plane defined by the traces 300. The grounding beams 310 extend forward from the front 226 of the holder 202 such that the grounding beams 310 may be loaded into the front housing 120 (shown in FIG. 1). Each grounding beam 310 has a mating interface 314 at a distal end thereof. The mating interface 314 is configured to engage the corresponding header shield 146. In an exemplary embodiment, the grounding beams 310 engage interior surfaces of the header shields 146.

In an exemplary embodiment, the grounding fingers 312 are bent or transitioned out of plane with respect to a plane defined by the traces 300. The grounding fingers 312 extend forward from the front 226 of the holder 202 such that the grounding fingers 312 may be loaded into the front housing 120. Each grounding finger 312 has a mating interface 316 at a distal end thereof. The mating interface 316 is configured to engage the corresponding header shield 146. In an exemplary embodiment, the grounding fingers 312 are transitioned away from the grounding beams 310 to engage an exterior of the header shield 146.

The ground leadframe 204 includes a plurality of mounting features 318 used to mechanically and/or electrically connect the ground leadframe 204 to the holder 202. The holder 202 includes retention features 320 and the mounting features 318 engage the retention features 320 to mechanically and/or electrically connect the ground leadframe 204 to the holder 202. In the illustrated embodiment, the mounting features 318 are openings through the ground leadframe 204 and the retention features 320 are posts or pegs extending from the side wall 222. The mounting features 318 are held on the retention features 320 by an interference fit. In an exemplary embodiment, the mounting features 318 are located proximate to the bussing portions 308. Any number of mounting features 318 may be used. The locations of the mounting features 318 may be varied from the illustrated locations depending on the particular embodiment. Other types of mounting features 318 other than openings may be used in alternative embodiments to secure the ground leadframe 204 to the holder 202, such as tabs, epoxy, solder and the like.

The ground leadframe 204 is loaded into the chamber 210 such that the traces 300 are received in corresponding channels 224. The frame assembly 230 is loaded into the chamber 210 such that the frame members 248 directly engage the traces 300. The traces 300 define an electrical path between the grounding members 302 at the front 304 and the ground pads 305 at the bottom 306. Optionally, the holder member 206 may include pockets 322 along the internal surface 214 that receive the ground leadframe 204 such that ground leadframe 204 is generally flush with the internal surface 214 of the side wall 221 when coupled thereto. The traces 300 of the ground leadframe 204 are positioned in line with and directly between the encased portions of the receptacle signal contacts 124 and the side wall 222 of the holder member 206. Thus, the ground path defined by the ground leadframe 204 extends within the holder 202.

The ground leadframe 204 includes a plurality of slots 324 along the bottom 306. The slots 324 are formed in the grounding pads 305. The slots 324 receive corresponding busbars 203. For example, the ground leadframe 204 on both sides of the slot 324 engages opposite sides 270, 272 of the busbar 203. In an exemplary embodiment, one or more protrusions 326 extend into each slot 324 to engage the buss bar 203. The protrusions 326 ensure an interference fit between the ground leadframe 204 and the buss bars 203. In an exemplary embodiment, the ground leadframe 204 includes deflectable beams 328 adjacent each slot 324. The deflectable beams 328 press against the buss bars 203 when loaded into the slots 324. The beams 328 ensure an interference fit between the ground leadframe 204 and the buss bars 203. Optionally, the protrusions 326 may extend from the beams 328.

The ground leadframe 205 is separate and distinct from the conductive holder 202, the ground leadframe 204, the side shield 200 and the frame assembly 230. The ground leadframe 205 is manufactured from a metal material. In an exemplary embodiment, the ground leadframe 205 is stamped and formed. The ground leadframe 205 may be a mirrored component of the ground leadframe 204. The ground leadframe 205 includes a plurality of traces 330 that from a leadframe extending between grounding members 332 that extend forward from a front 334 of the ground leadframe 205 and ground pads 335 at a bottom 336 of the ground leadframe 205.

The traces 330 are received in corresponding channels 225. The traces 330 mirror the paths of the receptacle signal contacts 124 through the dielectric frame 242. The traces 330 are connected by bussing portions 338 that electrically interconnect each of the traces 330. In the illustrated embodiment, the bussing portions 338 are provided proximate to the front 334 of the ground leadframe 205 and proximate to the bottom 336 of the ground leadframe 205. The bussing portions 338 may be provided at other locations in alternative embodiments. The grounding members 332 are configured to engage corresponding header shields 146. The grounding pads 335 are configured to engage corresponding buss bars 203.

In the illustrated embodiment, the ground leadframe 205 includes two types of grounding members 332, namely grounding beams 340 and grounding fingers 342. The grounding beams 340 are configured to be positioned between receptacle signal contacts 124 (e.g. in column with the receptacle signal contacts 124), while the grounding fingers 342 are configured to extend along the receptacle signal contacts 124 (e.g. aligned in row with the receptacle signal contacts 124, but out of column). The grounding beams 340 are configured to directly engage the center walls 156 (shown in FIG. 1) of the header shields 146, while the grounding fingers 342 are configured to directly engage the side walls 158 (shown in FIG. 1) of the header shields 146. The grounding fingers 342 are shorter than the grounding beams 340 such that the grounding fingers 342 engage the header shields 146 closer to the front 226 of the conductive holder 202 than the grounding beams 340. Other types of grounding members 332 may be used in alternative embodiments, such as grounding members that engage edges of the header shields 146 or other parts of the header shields 146.

In an exemplary embodiment, the grounding beams 340 are bent out of plane with respect to a plane defined by the traces 330 such that the grounding beams 340 are oriented perpendicular with respect to the plane defined by the traces 330. The grounding beams 340 extend forward from the front 226 of the holder 202 such that the grounding beams 340 may be loaded into the front housing 120 (shown in FIG. 1). Each grounding beam 340 has a mating interface 344 at a distal end thereof. The mating interface 344 is configured to engage the corresponding header shield 146. In an exemplary embodiment, the grounding beams 340 engage interior surfaces of the header shields 146.

In an exemplary embodiment, the grounding fingers 342 are bent or transitioned out of plane with respect to a plane defined by the traces 330. The grounding fingers 342 extend forward from the front 226 of the holder 202 such that the grounding fingers 342 may be loaded into the front housing 120. Each grounding finger 342 has a mating interface 346 at a distal end thereof. The mating interface 346 is configured to engage the corresponding header shield 146. In an exemplary embodiment, the grounding fingers 342 are transitioned away from the grounding beams 340 to engage an exterior of the header shield 146.

The ground leadframe 205 includes a plurality of mounting features 348 used to mechanically and/or electrically connect the ground leadframe 205 to the holder 202. The holder 202 includes retention features 350 and the mounting features 348 engage the retention features 350 to mechanically and/or electrically connect the ground leadframe 205 to the holder 202. In the illustrated embodiment, the mounting features 348 are openings through the ground leadframe 205 and the retention features 350 are posts or pegs extending from the side wall 221. The mounting features 348 are held on the retention features 350 by an interference fit. In an exemplary embodiment, the mounting features 348 are located proximate to the bussing portions 338. Any number of mounting features 348 may be used. The locations of the mounting features 348 may be varied from the illustrated locations depending on the particular embodiment. Other types of mounting features 348 other than openings may be used in alternative embodiments to secure the ground leadframe 205 to the holder 202, such as tabs, epoxy, solder and the like.

The ground leadframe 205 is loaded into the chamber 212 such that the traces 330 are received in corresponding channels 225. The frame assembly 230 is loaded into the chamber 212 such that the frame members 242 directly engage the traces 330. The traces 330 define an electrical path between the grounding members 332 at the front 334 and the ground pads 335 at the bottom 336. Optionally, the holder member 208 may include pockets 352 along the internal surface 216 that receive the ground leadframe 205 such that ground leadframe 205 is generally flush with the internal surface 216 of the side wall 223 when coupled thereto. The traces 330 of the ground leadframe 205 are positioned in line with and directly between the encased portions of the receptacle signal contacts 124 and the side wall 223 of the holder member 208. Thus, the ground path defined by the ground leadframe 205 extends within the holder 202.

The ground leadframe 205 includes a plurality of slots 354 along the bottom 336. The slots 354 are formed in the grounding pads 335. The slots 354 receive corresponding buss bars 203. In an exemplary embodiment, one, or more protrusions 356 extend into each slot 354 to engage the buss bar 203. The protrusions 356 ensure an interference fit between the ground leadframe 204 and the buss bars 203. In an exemplary embodiment, the ground leadframe 205 includes deflectable beams 358 adjacent each slot 354. The deflectable beams 358 press against the buss bars 203 when loaded into the slots 354. The beams 358 ensure an interference fit between the ground leadframe 204 and the buss bars 203. Optionally, the protrusions 356 may extend from the beams 358.

The holder members 206, 208 each include a plurality of slots 370 along the bottom 228. The slots 370 are aligned with the slots 324, 354 and receive corresponding buss bars 203. For example, the conductive bodies of the holder members 206, 208 on both sides of the slots 370 engage the opposite sides 270, 272 of the buss bar 203. In an exemplary embodiment, one or more protrusions 372 extend from one or both sides 270, 272 to engage the holder members 206, 208. The buss bars 203 are mechanically and electrically coupled to the holder members 206, 208. Ground pins 374 of the buss bars 203 are configured to be mounted to the circuit board 106 (shown in FIG. 1) to electrically connect the buss bars 203 to the circuit board 106.

Figure 3:
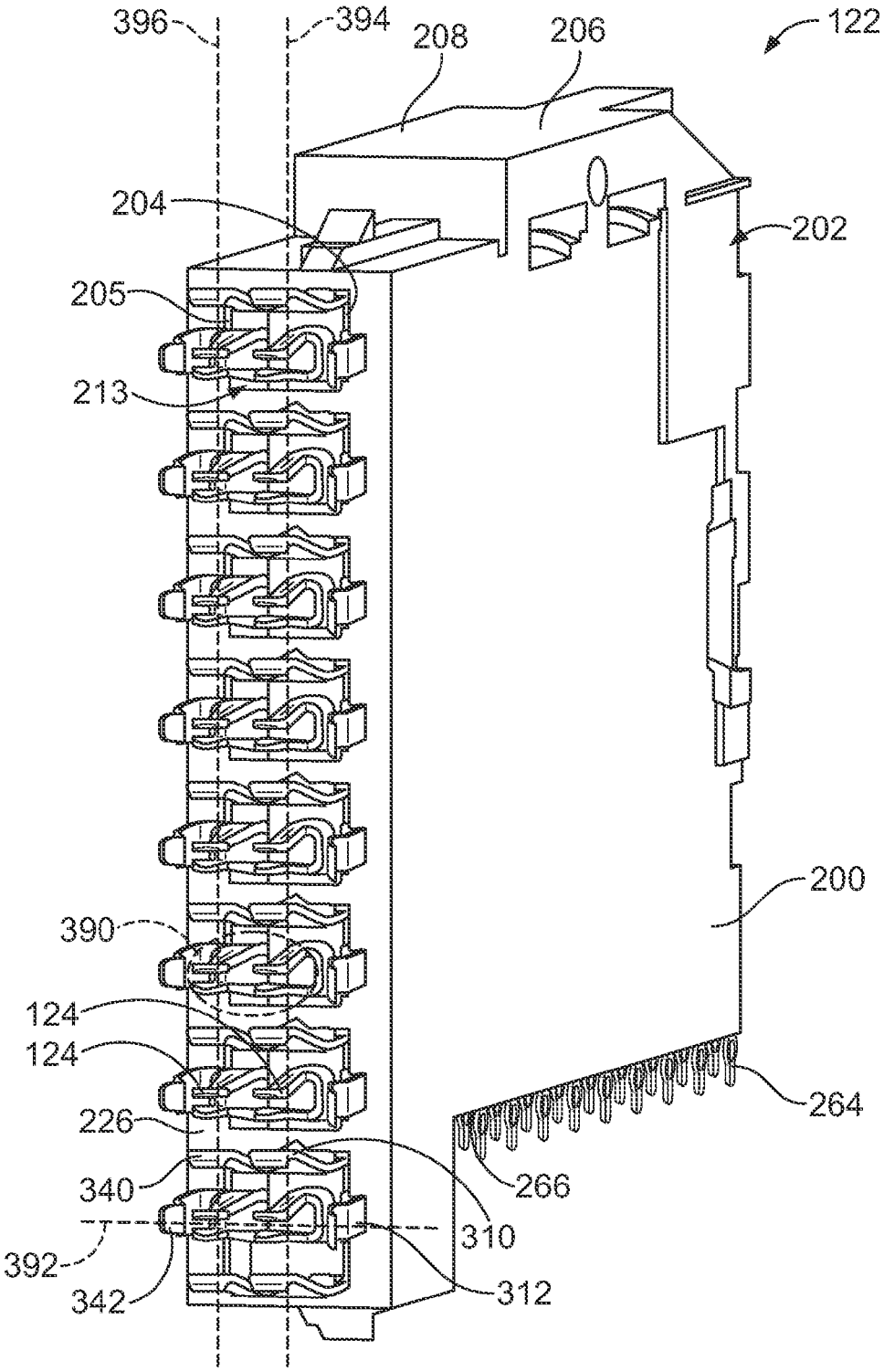
FIG. 3 is a perspective view of a contact module in an assembled state.

FIG. 3 is a perspective view of one of the contact modules 122 in an assembled state. During assembly, the dielectric frames 240, 242 (shown in FIG. 2) are received in the corresponding holder members 206, 208. The holder members 206, 208 are coupled together and generally surround the dielectric frames 240, 242. The dielectric frames 240, 242 are aligned adjacent one another such that the receptacle signal contacts 124 are aligned with one another and define contact pairs 390. Each contact pair 390 is configured to transmit differential signals through the contact module 122. The receptacle signal contacts 124 within each contact pair 390 are arranged in rows that extend along row axes 392. The receptacle signal contacts 124 within the dielectric frame 240 are arranged within a column along a column axis 394. Similarly, the receptacle signal contacts 124 of the dielectric frame 242 are arranged in a column along a column axis 396.

The side shield 200, buss bars 203 (shown in FIG. 2) and ground leadframes 204, 205 are coupled to the holder 202 to provide shielding for the receptacle signal contacts 124. When assembled, the side shield 200 is positioned on an exterior of the holder 202. The ground pins 264 extend from the bottom 266 of the side shield 200 for termination to the circuit board 106. The ground pins 264 are aligned generally along the exterior surface of the holder 202 and are configured to be aligned at the interface of the contact module 122 with an adjacent contact module 122 (not shown). The ground pins 264 provide shielding between the receptacle signal contacts 124 of the contact module 122 and the receptacle signal contacts of the adjacent contact module 122 (not shown). Optionally, more than one side shield 200 may be provided, and the side shields may have different sizes and/or shapes than the side shield 200 illustrated in FIG. 3.

The ground leadframes 204, 205 are positioned interior of the common chamber 213. The ground leadframes 204, 205 are configured to electrically connect to the header shields 146 when the receptacle assembly 102 is coupled to the header assembly 104 (both shown in FIG. 1). The grounding beams 310, 340 and grounding fingers 312; 342 create direct electrical paths from the header shields 146 into the interior of the holder 202. The grounding beams 310, 340 provide shielding for the receptacle signal contacts 124 in the dielectric frame 240 and the dielectric frame 242, respectively. The grounding beams 310, 340 are aligned with the contact pairs 390 along the column axis 394 and the column axis 396, respectively. In an exemplary embodiment, grounding beams 310, 340 are provided below the lowermost contact pair 390, above the uppermost contact pair 390, and between each of the contact pairs 390. Each of the contact pairs 390 is thereby shielded both above and below its respective row axis 392.

The grounding fingers 312, 342 extend forward from the front 226 along the sides of the contact pairs 390. The grounding fingers 312, 342 are generally aligned with the contact pairs 390 along the row axes 392. The grounding fingers 312, 342 are generally aligned horizontally with the contact pairs 390 while the grounding beams 310, 340 are positioned vertically between the contact pairs 390. The grounding fingers 312, 342 are vertically offset with respect to the grounding beams 310, 340. For example, the grounding beams 310, 340 are generally aligned with the column axes 394, 396, while the grounding fingers 312, 342 are offset horizontally outside of the column axes 394, 396.

Figure 4:
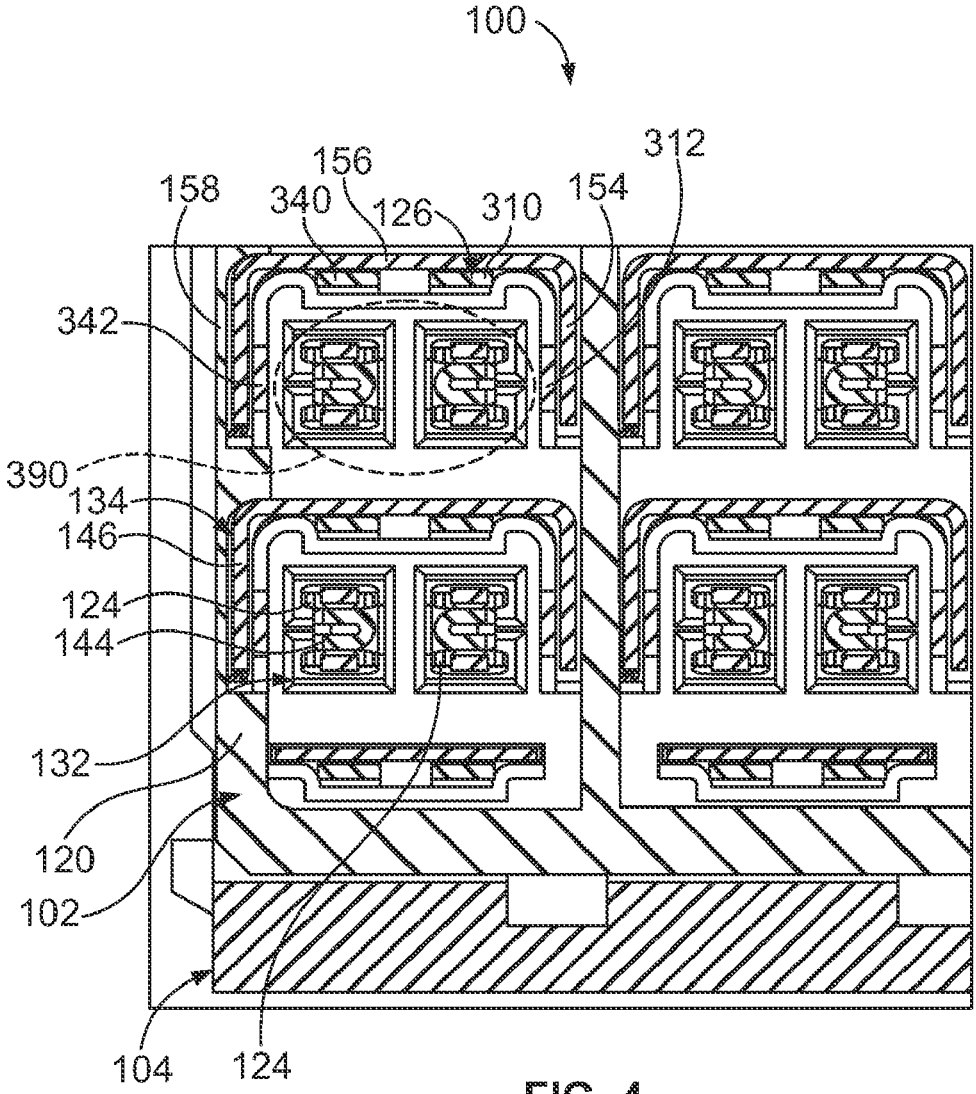
FIG. 4 is a partial sectional view of a portion of the electrical connector system shown in FIG. 1 illustrating the receptacle assembly mated to the header assembly.

FIG. 4 is a partial sectional view of a portion of the electrical connector system 100 showing the receptacle assembly 102 mated to the header assembly 104. The grounding electrical connection between the shield structure 126 and the header shields 146 is illustrated in FIG. 4. The first and second ground leadframes 204, 205 (shown in FIG. 2) are electrically connected to corresponding header shields 146.

The front housing 120 of the receptacle assembly 102 includes the signal contact openings 132 and the ground contact openings 134. When the header assembly 104 and receptacle assembly 102 are mated, the header signal contacts 144 are mated to the receptacle signal contacts 124 within the signal contact openings 132. The header shields 146 are received in the ground contact openings 134.

The grounding beams 310, 340 engage and are electrically connected to corresponding header shields 146 within the ground contact openings 134. The grounding beams 310, 340 engage the interior surface of the main wall 156 of the C-shaped header shields 146 to make electrical connection therewith. In an exemplary embodiment, the grounding beams 310, 340 are deflectable and are configured to be spring biased against the header shields 146 to ensure electrical connection with the header shields 146.

The grounding fingers 312, 342 engage and are electrically connected to corresponding header shields 146 within the ground contact openings 134. The grounding fingers 312, 342 engage the exterior surfaces of the side walls 154, 158, respectively, of the C-shaped header shields 146 to make electrical connection therewith. The grounding fingers 312, 342 transition out of the holder 202 (shown in FIG. 2) in an outward direction (e.g. away from the receptacle signal contacts 124) to provide clearance between the grounding fingers 312, 342 and the receptacle signal contacts 124 to avoid inadvertent or unintentional contact between the grounding fingers 312, 342 and the receptacle signal contacts 124 and/or to provide adequate clearance to avoid shorting, arcing or impedance control. In an exemplary embodiment, the grounding fingers 312, 342 are deflectable and are configured to be spring biased against the header shields 146 to ensure electrical connection with the header shields 146. In an alternative embodiment, the grounding fingers 312, 342 may engage the interior surfaces of the side walls 154, 158.

In an exemplary embodiment, the header shields 146 and the shield structure 126 provide 360° shielding for the receptacle signal contacts 124. For example, the center walls 156 above the pairs 390 of the receptacle signal contacts 124 provide shielding above the pairs 390 of receptacle signal contacts 124. The side walls 154 extend along first sides of the receptacle signal contacts 124 to provide shielding along such sides of the receptacle signal contacts 124. The side walls 158 extend along second sides of the receptacle signal contacts 124 to provide shielding along such sides of the receptacle signal contacts 124. The center walls 156 below the pairs 390 of the receptacle signal contacts 124 provide shielding below the pairs 390 of receptacle signal contacts 124. Thus all sides of the pairs 390 of receptacle signal contacts are shielded. The header shields 146 provide shielding between rows of receptacle signal contacts 124 and between columns of the pairs of receptacle signal contacts 124, such as between receptacle signal contacts 124 held within different contact modules 122. The grounding beams 310, 340 define two points of contact with the center wall 156 of each header shield 146 and the grounding fingers 312, 342 define points of contact with the side walls 154, 158 of each header shield 146. The shield structure 126 thus has multiple, redundant points of contact with each of the C-shaped header shields 146. The electrical performance of the electrical connector system 100 is enhanced with multiple ground contact points to the C-shaped header shield 146, as compared to systems that have a single ground contact point.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as, the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a contact module including a conductive holder having a first side and an opposite second side, the conductive holder having a chamber between the first and second sides;

a frame assembly received in the chamber of the conductive holder, the frame assembly comprising a plurality of contacts and a dielectric frame supporting the contacts, the contacts extending from the conductive holder for electrical termination; and a ground leadframe received in the chamber between the frame assembly and the conductive holder, the ground leadframe having grounding members extending from the conductive holder for electrical termination to header shields of the header assembly.

2. The receptacle assembly of claim 1, wherein the ground lead frame includes traces mirroring a path of the contacts through the dielectric frame.

3. The receptacle assembly of claim 1, wherein the ground lead frame includes individual traces, the ground lead frame including bussing portions connecting the traces.

4. The receptacle assembly of claim 1, wherein the ground lead frame includes mounting features, the conductive holder includes retention features engaging the mounting features to mechanically and electrically couple the ground lead frame to the conductive holder.

5. The receptacle assembly of claim 1, wherein the conductive holder includes a pocket that receives the ground lead frame.

6. The receptacle assembly of claim 1, wherein the grounding members comprise grounding beams extending between contacts and grounding fingers extending along sides of the contacts, the grounding beams and grounding fingers being offset with respect to one another.

7. The receptacle assembly of claim 1, wherein the ground lead frame includes a plurality of slots therein, the receptacle assembly further comprising a plurality of buss bars discrete from the ground lead frame and received in corresponding slots to electrically connect the ground lead frame to the buss bars.

8. The receptacle assembly of claim 1, wherein the conductive holder includes a plurality of slots therein, the receptacle assembly further comprising a plurality of buss bars discrete from the conductive holder and received in corresponding slots to electrically connect the conductive holder to the buss bars.

9. The receptacle assembly of claim 1, further comprising a side shield electrically and mechanically coupled to an exterior of the conductive holder at the first side, the side shield having a plurality of ground pins extending therefrom for termination to a circuit board to electrically connect the conductive holder to the circuit board.

10. A receptacle assembly comprising:

a front housing configured for mating with a header assembly; and a contact module coupled to the front housing, the contact module comprising:

a conductive holder having a first holder member and second holder member coupled to the first holder member, the conductive holder having a front coupled to the front housing and a bottom configured to be mounted to a circuit board, the conductive holder having a chamber between the first and second holder members, the chamber including a plurality of channels extending between the front and the bottom;

a frame assembly received in the chamber, the frame assembly comprising a first dielectric frame received in the first holder member and a second dielectric frame received in the second holder member, each dielectric frame comprising a plurality of contacts and frame members supporting the contacts, the contacts being routed through corresponding channels, the contacts extending from the front and the bottom for electrical termination;

a first ground leadframe received in the chamber in the first holder member between the first dielectric frame and the first holder member, the first ground leadframe having traces being routed through corresponding channels, the first ground leadframe having grounding members extending from the conductive holder for electrical termination to header shields of the header assembly; and a second ground leadframe received in the chamber in the second holder member between the second dielectric frame and the second holder member, the second ground leadframe having traces being routed through corresponding channels, the second ground leadframe having grounding members extending from the conductive holder for electrical termination to header shields of the header assembly.

11. The receptacle assembly of claim 10, wherein the traces mirror a path of the contacts through the channels.

12. The receptacle assembly of claim 10, wherein the first ground lead frame includes bussing portions connecting the traces thereof, and the second ground lead frame includes bussing portions connecting the traces thereof.

13. The receptacle assembly of claim 10, wherein the conductive holder includes retention features, the first and second ground lead frames includes mounting features engaging corresponding retention features to mechanically and electrically couple the first and second ground lead frames to the conductive holder.

14. The receptacle assembly of claim 10, wherein the grounding members of the first and second ground leadframes comprise grounding beams extending between contacts and grounding fingers extending along sides of the contacts, the grounding beams and grounding fingers being offset with respect to one another.

15. The receptacle assembly of claim 10, wherein the first and second ground lead frames each include a plurality of slots therein, the receptacle assembly further comprising a plurality of buss bars discrete from the first and second ground lead frames and received in corresponding slots of the first and second ground leadframes to electrically connect the first and second ground lead frames to the buss bars.

16. The receptacle assembly of claim 10, wherein the conductive holder includes a plurality of slots therein, the receptacle assembly further comprising a plurality of buss bars discrete from the conductive holder and received in corresponding slots to electrically connect the conductive holder to the buss bars.

17. The receptacle assembly of claim 10, further comprising a side shield electrically and mechanically coupled to an exterior of the conductive holder at an exterior side thereof, the side shield having a plurality of ground pins extending therefrom, for termination to a circuit board to electrically connect the conductive holder to the circuit board.

18. An electrical connector assembly comprising:

a header assembly comprising a header housing, a plurality of header contacts held by the header housing, and a plurality of C-shaped header shields surrounding corresponding header contacts, the header shields having walls defining the C-shaped header shields; and a receptacle assembly matable to the header assembly, the receptacle assembly comprising:

a front housing matable to the header housing; and a. contact module coupled to the front housing, the contact module comprising:

a conductive holder having a first holder member and second holder member coupled to the first holder member, the conductive holder having a front coupled to the front housing and a bottom configured to be mounted to a circuit board, the conductive holder having a chamber between the first and second holder members, the chamber including a plurality of channels extending between the front and the bottom;

a frame assembly received in the chamber, the frame assembly comprising a first dielectric frame received in the first holder member and a second dielectric frame received in the second holder member, each dielectric frame comprising a plurality of contacts and frame members supporting the contacts, the contacts being routed through corresponding channels, the contacts extending from the front of the conductive holder for electrical termination to corresponding header contacts;

a first ground leadframe received in the chamber in the first holder member between the first dielectric frame and the first holder member, the first ground leadframe having traces being routed through corresponding channels, the first ground leadframe having grounding members extending from the conductive holder for electrical termination to header shields of the header assembly; and a second ground leadframe received in the chamber in the second holder member between the second dielectric frame and the second holder member, the second ground leadframe having traces being routed through corresponding channels, the second ground leadframe having grounding members extending from the conductive holder for electrical termination to header shields of the header assembly.

19. The electrical connector assembly of claim 18, wherein the grounding members of the first and second ground leadframes comprise grounding beams extending between contacts and grounding fingers extending along sides of the contacts, the grounding beams and grounding fingers engaging interior surfaces of the header shields.

20. The electrical connector assembly of claim 18, wherein the walls of the header shields comprise central walls and side walls extending from opposite ends of the central walls, the grounding members of the first and second ground leadframes comprise grounding beams engaging corresponding central walls of the header shields and grounding fingers engaging corresponding side walls of the header shields.

* * * * *